US010397693B1

(12) United States Patent
Tao et al.

(10) Patent No.: US 10,397,693 B1
(45) Date of Patent: Aug. 27, 2019

(54) ACOUSTIC CHAMBERS DAMPED WITH PLURAL RESONANT CHAMBERS, AND RELATED SYSTEMS AND METHODS

(71) Applicant: Apple Inc., Cupertino, CA (US)

(72) Inventors: Hongdan Tao, Campbell, CA (US); Anthony P. Grazian, Los Gatos, CA (US); Christopher Wilk, Los Gatos, CA (US); Matthew A. Donarski, San Francisco, CA (US); Michael J. Newman, Sunnyvale, CA (US); Onur I. Ilkorur, Campbell, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/917,426

(22) Filed: Mar. 9, 2018

(51) Int. Cl.
*H04R 1/28* (2006.01)
*H04R 1/02* (2006.01)

(52) U.S. Cl.
CPC ..... *H04R 1/2811* (2013.01); *H04R 1/025* (2013.01)

(58) Field of Classification Search
None
See application file for complete search history.

(56) References Cited

U.S. PATENT DOCUMENTS 5,012,890 A 5/1991 Nagle et al.
5,479,520 A 12/1995 Nieuwendijk et al.
5,514,841 A * 5/1996 Rochon ..... H04R 1/2819 181/145
7,740,104 B1 * 6/2010 Parkins ..... A61F 11/08 181/128
2017/0332167 A1 * 11/2017 Liu ..... H04R 1/026
2018/0081406 A1 * 3/2018 Kita ..... H04R 11/02

FOREIGN PATENT DOCUMENTS

EP 1685741 4/2013

* cited by examiner

*Primary Examiner* — Paul W Huber
(74) *Attorney, Agent, or Firm* — Ganz Pollard, LLC

(57) ABSTRACT

An acoustic enclosure has a housing at least partially defining an acoustic chamber for an acoustic radiator. The housing defines an acoustic port from the acoustic chamber to a surrounding environment. An acoustic resonator has a first resonant chamber and a second resonant chamber. The acoustic resonator also has a first duct to acoustically couple the first resonant chamber with the acoustic chamber and a second duct to acoustically couple the second resonant chamber with the first resonant chamber. An electronic device can have an electro-acoustic transducer. Circuitry in the electronic device can drive the electro-acoustic transducer to emit sound over a selected frequency bandwidth. Damping provided by the first and the second resonant chambers can de-emphasize one or more frequencies and/or extend a frequency response of the acoustic enclosure to improve perceived sound quality emitted by the electronic device.

20 Claims, 5 Drawing Sheets

ACOUSTIC CHAMBERS DAMPED WITH PLURAL RESONANT CHAMBERS, AND RELATED SYSTEMS AND METHODS

FIELD

This application and related subject matter (collectively referred to as the "disclosure") generally concern acoustic chambers damped with plural resonant chambers, and related systems and methods. More particularly, but not exclusively, this disclosure pertains to loudspeaker enclosures defining an acoustic chamber acoustically coupled with and damped by a resonator having first and second resonant chambers acoustically coupled with each other. As but one illustrative example, an electronic device can incorporate an acoustic chamber damped by plural resonant chambers acoustically coupled with each other in series relative to the acoustic chamber.

BACKGROUND INFORMATION

Typical electro-acoustic transducers have an acoustic radiator and typical loudspeakers pair such an acoustic radiator with an acoustic chamber to accentuate and/or to damp selected acoustic frequency bands. Conventional acoustic chambers and acoustic radiators often are large compared to many electronic devices.

More particularly, but not exclusively, many commercially available electronic devices have a characteristic length scale equivalent to or larger than a characteristic length scale of conventional acoustic chambers and acoustic radiators. Representative electronic devices include, by way of example, portable personal computers (e.g., smartphones, smart speakers, laptop, notebook and tablet computers), desktop personal computers, wearable electronics (e.g., smart watches).

Consequently, many electronic devices do not incorporate conventional acoustic radiators and acoustic chambers, given their incompatible size differences. As a further consequence, some electronic devices do not provide an audio experience to users on par with that provided by more conventional, albeit larger, loudspeakers.

SUMMARY

In some respects, concepts disclosed herein concern acoustic enclosures having an acoustic chamber damped with plural resonant chambers.

As an example, a disclosed acoustic enclosure includes a housing defining an acoustic chamber for an acoustic radiator. The housing further defines an acoustic port from the acoustic chamber to a surrounding environment. An acoustic resonator has a first resonant chamber and a second resonant chamber. The acoustic resonator also has a first duct to acoustically couple the first resonant chamber with the acoustic chamber, as well as a second duct to acoustically couple the second resonant chamber with the first resonant chamber.

The first acoustic duct can define a contraction region positioned between the acoustic chamber and the first resonant chamber. The second acoustic duct can define a contraction region positioned between the first resonant chamber and the second resonant chamber.

The acoustic resonator can be arranged to resonate at a frequency corresponding to a quarter-wavelength resonance of the acoustic chamber to extend a frequency bandwidth of sound emitted within the acoustic chamber.

The housing can include an acoustic chassis defining a pair of longitudinally spaced-apart wall segments defining a gap therebetween. The acoustic chassis can also define a recessed region corresponding to the resonator. The wall segments and the gap can be positioned between the recessed region and the acoustic chamber. Further, the wall segments and the gap can be arranged to define a contraction region between the acoustic chamber and the first resonant chamber of the resonator.

The acoustic enclosure can also include an insert. The insert can be matingly engageable with the acoustic chassis to segregate the recessed region and to define the second resonant chamber. For example, the second resonant chamber can be defined between the insert and a corresponding segregated portion of the recessed region. The insert can define the second duct.

The acoustic resonator can constitute a first acoustic resonator and the acoustic enclosure can also have a second acoustic resonator acoustically coupled with the acoustic chamber.

According to another aspect, a loudspeaker assembly has an acoustic radiator defining a first major surface and an opposed second major surface. A housing defines an acoustic chamber positioned adjacent, and at least partially bounded by, the first major surface of the acoustic radiator. The housing also defines an acoustic port from the acoustic chamber to a surrounding environment. An acoustic resonator has a first resonant chamber and a second resonant chamber. The acoustic resonator also has a first duct to acoustically couple the first resonant chamber with the acoustic chamber. Further, the acoustic resonator has a second duct to acoustically couple the second resonant chamber with the first resonant chamber.

The second major surface of the acoustic radiator can define a boundary of an adjacent region. The adjacent region is acoustically decoupled from the acoustic chamber, the first resonant chamber, the second resonant chamber, or a combination thereof.

In such a loudspeaker assembly, the first acoustic duct can define a contraction region positioned between the acoustic chamber and the first resonant chamber. The second acoustic duct can define a contraction region positioned between the first resonant chamber and the second resonant chamber.

An insert can define a wall separating the first resonant chamber from the second resonant chamber. The second duct can have an aperture extending through the wall from the first resonant chamber to the second resonant chamber.

A wall can be positioned between the acoustic chamber and the first resonant chamber.

The wall can define an open gap that constitutes a portion of the first acoustic duct.

The acoustic resonator can be arranged to resonate at a frequency corresponding to a quarter-wavelength resonance of the acoustic chamber to extend a frequency bandwidth of sound emitted by the acoustic radiator. The acoustic resonator can be a first acoustic resonator. The loudspeaker assembly can include a second acoustic resonator.

According to yet another aspect, an electronic device includes an electro-acoustic transducer, as well as circuitry to drive the electro-acoustic transducer to emit sound over a selected frequency bandwidth. For example, such circuitry can include a processor and a memory. The memory can contain instructions that, when executed by the processor, cause the electronic device to drive the electro-acoustic transducer to emit sound over a selected frequency bandwidth.

A ported acoustic chamber is positioned adjacent the electro-acoustic transducer. The electronic device also has an acoustic resonator. The acoustic resonator has a first resonant chamber and a second resonant chamber. The first resonant chamber is acoustically coupled with and positioned between the acoustic chamber and the second resonant chamber.

The acoustic resonator can be arranged to resonate at a frequency corresponding to a quarter-wavelength resonance of the ported acoustic chamber. Such a resonance by the acoustic resonator can extend a frequency bandwidth of sound emitted by the electronic device compared to the selected frequency bandwidth emitted by the electro-acoustic transducer.

The acoustic resonator can be a first acoustic resonator, and the electronic device can include a second acoustic resonator. The second acoustic resonator can have a corresponding first resonant chamber and a corresponding second resonant chamber. The first resonant chamber corresponding to the second acoustic radiator can acoustically couple with, and be positioned between, the acoustic chamber and the second resonant chamber corresponding to the second acoustic resonator.

A wall can be positioned between the acoustic chamber and the first resonant chamber. An opening can extend through the wall to acoustically couple the acoustic chamber with the first resonant chamber. The electronic device can also have another wall positioned between the first resonant chamber and the second resonant chamber. An opening can extend through the other wall to acoustically couple the first resonant chamber with the second resonant chamber.

Also disclosed are associated methods, as well as tangible, non-transitory computer-readable media including computer executable instructions that, when executed, cause a computing environment to implement one or more methods disclosed herein. Digital signal processors embodied in software, firmware, or hardware and being suitable for implementing such instructions also are disclosed.

The foregoing and other features and advantages will become more apparent from the following detailed description, which proceeds with reference to the accompanying drawings.

BRIEF DESCRIPTION OF THE DRAWINGS

Referring to the drawings, wherein like numerals refer to like parts throughout the several views and this specification, aspects of presently disclosed principles are illustrated by way of example, and not by way of limitation.

DETAILED DESCRIPTION

The following describes various principles related to audio appliances responsive to ultrasonic signal content, and related systems and methods. For example, some disclosed principles pertain to acoustic systems, methods, and components to damp resonance at certain frequencies. That said, descriptions herein of specific appliance, apparatus or system configurations, and specific combinations of method acts, are but particular examples of contemplated appliances, components, systems, and methods chosen as being convenient illustrative examples of disclosed principles. One or more of the disclosed principles can be incorporated in various other appliances, components, systems, and methods to achieve any of a variety of corresponding, desired characteristics. Thus, a person of ordinary skill in the art, following a review of this disclosure, will appreciate that appliances, components, systems, and methods having attributes that are different from those specific examples discussed herein can embody one or more presently disclosed principles, and can be used in applications not described herein in detail. Such alternative embodiments also fall within the scope of this disclosure.

I. Overview

Given size constraints, some electronic devices incorporate so-called "micro-speakers." Examples of micro-speakers include a speakerphone speaker or an earpiece receiver found within an earphone, headphone, smart-phone, or other similar compact electronic device, such as, for example, a portable time-piece, or a tablet-, notebook-, or laptop-computer.

Figure 1:
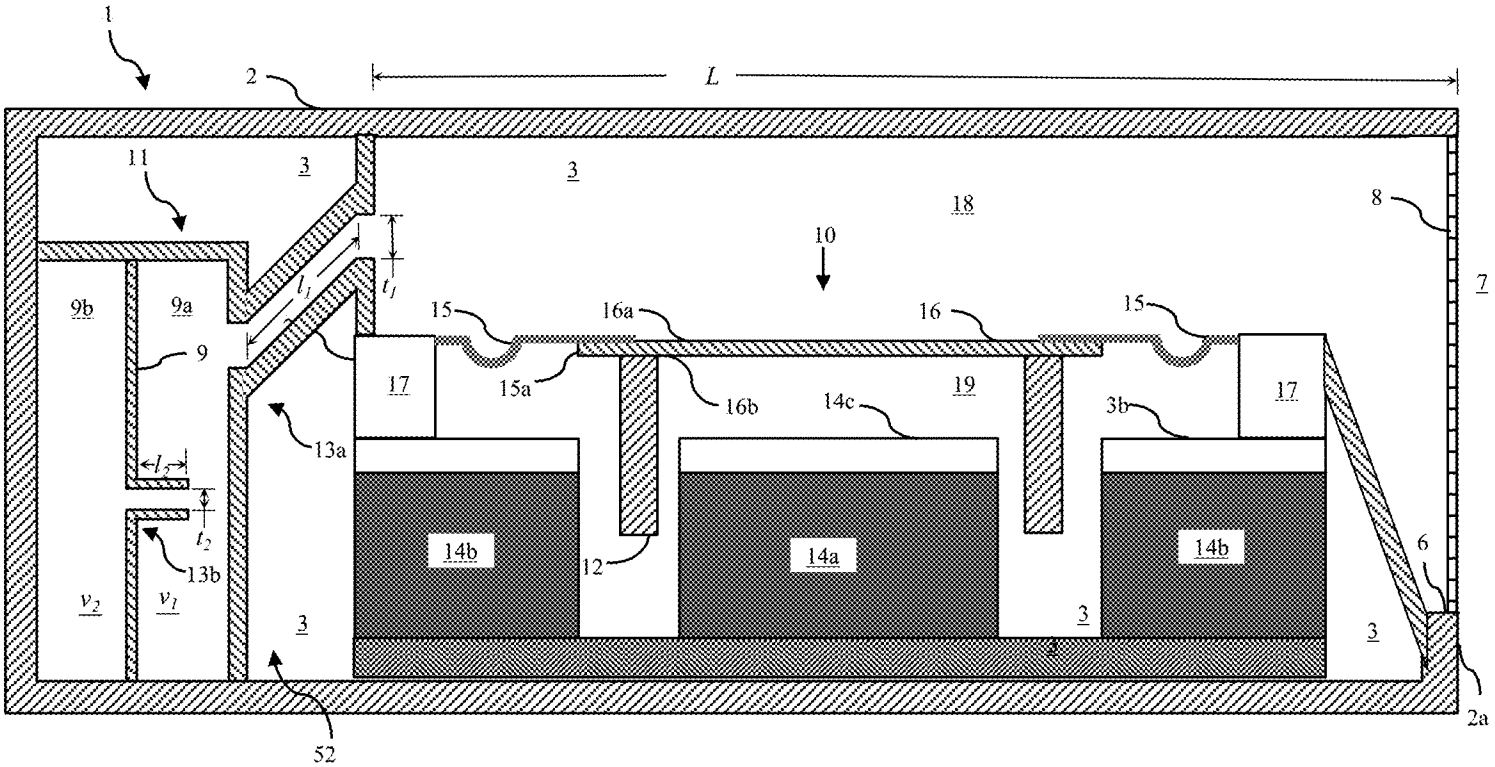
FIG. 1 illustrates a cross-sectional view of an assembly including an acoustic enclosure and a loudspeaker transducer.

Micro-speakers operate on principles similar, but not necessarily identical, to larger electro-acoustic transducers. For example, as shown in FIG. 1, a micro-speaker 10 can incorporate a voice coil 12 and a corresponding magnet 14 to cause the voice coil to reciprocate in correspondence with variations in electrical current through the voice coil. Such micro-speakers can have a diaphragm 16 or other acoustic radiator so coupled with the voice coil 12 as to cause the acoustic radiator to emit sound. However, given their limited physical size, output levels attainable by micro-speakers are limited. Some electronic devices acoustically couple such a micro-speaker with one or more open regions suitable for improving radiated sound, as in the nature of an acoustic chamber 18. A diameter or major axis of a micro-speaker diaphragm can measure, for example, between about 10 mm and about 75 mm, such as between about 15 mm and about 65 mm, for example, between about 20 mm and about 50 mm.

Figure 2:
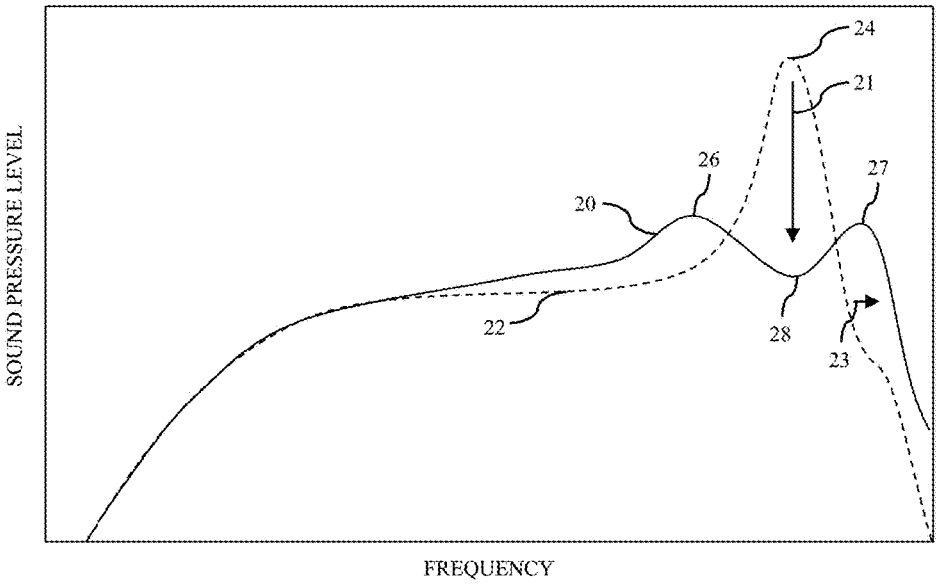
FIG. 2 illustrates a frequency response of an acoustic enclosure damped with an acoustic resonator and a frequency response of an acoustic enclosure without such damping.

An acoustic chamber 18 or other acoustic system can be characterized by a range of frequencies (sometimes referred to in the art as a "bandwidth"), as shown in FIG. 2, over which observed sound-pressure level (SPL) 20, 22 losses are less than a selected threshold level. Sometimes, a loss of less than three decibels (−3 dB) SPL is used to characterize the bandwidth provided by a given acoustic enclosure or other system.

An acoustic frequency having a quarter-wavelength substantially equal to a characteristic length of a ported acoustic chamber can resonate (e.g., form a standing wave) within the chamber, making radiated sound louder at that frequency than at other frequencies. The frequency at which this occurs is sometimes referred to in the art as the "Quarter Wave Resonance (QWR) frequency," which represents a unit-of-measure for a given acoustic chamber and can differ among chambers with different geometries.

Additionally, an acoustic wave propagating at the QWR frequency (or above) can be 180-degrees out-of-phase relative to a loudspeaker diaphragm or other acoustic radiator exciting an air mass in the acoustic chamber. Consequently, sound loudness can rapidly decay at frequencies beyond the QWR frequency for a given acoustic chamber and negatively affect a perceived quality of sound radiated by the acoustic chamber.

Referring again to FIGS. 1 and 2, an acoustic chamber 18 providing a relatively wider bandwidth 20 compared to a bandwidth 22 provided by another acoustic chamber (not shown) may be perceived as providing relatively better sound quality than the other chamber. As described more fully herein, one or more resonant chambers 13*a*, 13*b* acoustically coupled with an acoustic chamber 18 can damp resonance at certain frequencies, as indicated by the arrow 21, and extend a frequency response, as indicated by the arrow 23, of the acoustic chamber compared to acoustic chambers that lack such damping. Consequently, an acoustic enclosure and/or an electronic device having an acoustic chamber damped with plural resonant chambers can improve perceived sound quality compared to previous enclosures and/or devices.

II. Electro-Acoustic Transducers

There are numerous types of electro-acoustic transducers or drivers for loudspeakers (or micro-speakers).

Referring still to FIG. 1, a traditional direct radiator, for example, can include an electrodynamic loudspeaker 10 having a coil 12 of electrically conductive wire (sometimes referred to in the art as a "voice coil") immersed in a static magnetic field, e.g., associated with the magnets 14*a*, 14*b*, and coupled to a diaphragm 16 and a suspension system 15. The conductive wire (e.g., copper clad aluminum) is sometimes referred to as a "voice coil wire."

One or more magnets 14*a*, 14*b* (e.g., an NdFeB magnet) can be so positioned adjacent the voice coil 12 as to cause a magnetic field of the magnet(s) 14*a*, 14*b* to interact with a magnetic flux corresponding to an electrical current through the voice coil 12. In the particular embodiment shown in FIG. 1, the voice coil 12 is positioned between an inner magnet 14*a* and an outer magnet 14*b*. With the configuration in FIG. 1, the voice coil 12 is configured to move pistonically to and fro between a distal-most position and a proximal-most position relative to the inner magnet 14*a*. One or more magnet surfaces, e.g., a top-plan surface 14*c* facing the diaphragm 16, can have a contour corresponding to a contour of a major surface 16*b* of the diaphragm. For example, a magnet used in connection with a diaphragm having a convex major surface facing the magnet can define a corresponding concave recess or other contoured region. A magnet with such a contoured surface can matingly receive the diaphragm at a lower-most excursion from an at-rest position and maintain alignment of the diaphragm under large excursions.

With loudspeakers as in FIG. 1, the diaphragm 16 and the coil 12 are movable in correspondence with each other. As current alternates in direction through the voice coil 12, mechanical forces develop between the magnetic fields of the voice coil 12 and the magnet(s) 14*a*, 14*b*, urging the voice coil (and thus the diaphragm 16) to move, e.g., to reciprocate. As the respective current or voltage potential alternates, e.g., at an audible frequency, the voice coil 12 (and diaphragm 16) can move, e.g., reciprocate pistonically, and radiate sound.

The transducer module 10 has a frame 17 and a suspension system 15 supportively coupling the acoustic diaphragm 16 with the frame. The diaphragm 16 can be stiff (or rigid) and lightweight. Ideally, the diaphragm 16 exhibits perfectly pistonic motion. The diaphragm, sometimes referred to as a cone or a dome, e.g., in correspondence with its selected shape, may be formed from aluminum, paper, plastic, composites, or other materials that provide high stiffness, low mass, and are suitably formable during manufacture.

The suspension system 15 generally provides a restoring force to the diaphragm 16 following an excursion driven by interactions of the magnetic fields from the voice coil 12 and the magnet(s) 14*a*, 14*b*. Such a restoring force can return the diaphragm 16 to a neutral position, e.g., as shown in FIG. 1. The suspension system 15 can maintain the voice coil 12 in a desired range of positions relative to the magnet(s) 14*a*, 14*b*. For example, the suspension 15 can provide for controlled axial motion (e.g., pistonic motion) of the diaphragm 16 and voice coil 12 while largely preventing lateral motion or tilting that could cause the coil to strike other motor components, such as, for example, the magnet(s) 14*a*, 14*b*.

A measure of resiliency (e.g., a position-dependent stiffness) of the suspension 15 can be chosen to match a force vs. deflection characteristic of the voice coil 12 and motor (e.g., magnet 14*a*, 14*b*) system. The illustrated suspension system 15 includes a surround extending outward of an outer periphery 15*a* of the diaphragm 16. The surround member can be formed from a polyurethane foam material, a silicone material, or other pliant material. In some instances, the surround may be compressed into a desired shape by heat and pressure applied to a material in a mold, or die.

The diaphragm 16 has a first major surface 16*a* partially bounding the acoustic chamber 18, and an opposed second major surface 16*b*. A first end of the voice coil 12 can be chemically or otherwise physically bonded to the second major surface 16*b* of the acoustic diaphragm 16. For example, in FIG. 1, a voice coil 12 is physically coupled with the second major surface 16*b*.

Alternatively, a voice coil wire can be wrapped around a non-conductive bobbin, sometimes referred to as a "voice coil former." The voice coil former can be physically attached, e.g., bonded, to the major surface 16*b* of the acoustic diaphragm 16. Such a voice coil former can provide a platform for transmitting mechanical force and mechanical stability to the diaphragm 16, generally as described above in connection with the voice coil.

The voice coil 12 and/or the voice coil former can have a cross-sectional shape corresponding to a shape of the major surface of the diaphragm 16. For example, the diaphragm 16 can have a substantially circular, rectilinear, ovular, race-track or other shape when viewed in plan from above (or below). Similarly, the voice coil (or voice coil former) can have a substantially circular, rectilinear, ovular, race-track or other cross-sectional shape. In other instances, the cross-sectional shape of the voice coil former can differ from a shape of the diaphragm when viewed in plan from above (or below).

Other forms of driver are contemplated for use in connection with disclosed technologies. For example, piezo-electric drivers, ribbon drivers, and other flexural transducers can suspend an electro-responsive diaphragm within a frame. The diaphragm can change dimension or shape or otherwise deflect responsive to an electrical current or an electrical potential applied across the diaphragm (or other member physically coupled (directly or indirectly) with the diaphragm). As in the case of piezo-electric transducers, the deflection can arise by virtue of internal mechanical forces arising in correspondence to electrical current or potential. As in the case of, for example, electrostatic (or planar-magnetic) transducers, mechanical forces between a diaphragm and a stator arise by virtue of variations in electrostatic fields between the diaphragm and the stator, urging the diaphragm to vibrate and radiate sound.

And, although not shown, loudspeaker transducers can include other circuitry (e.g., application-specific integrated circuits (ASICs)) or electrical devices (e.g., capacitors, inductors, and/or amplifiers) to condition and/or drive electrical signals through the voice coil. Such circuitry can constitute a portion of a computing environment described herein.

III. Acoustic Enclosures

In FIG. 1, the loudspeaker module 10 is positioned in an acoustic enclosure 1. The acoustic enclosure 1 can be a stand-alone apparatus, as in the case of, for example, a traditional bookshelf speaker or a smart speaker. Alternatively, the acoustic enclosure 1 can constitute a defined region within an encasement of another device, such as, for example, a smart phone.

In either event, the acoustic enclosure 1 in FIG. 1 includes a housing 2 defining an open interior region 3. The loudspeaker diaphragm 16, or more generally, the acoustic radiator, is positioned in the open interior region 3 and defines a first major surface 16*a* and an opposed second major surface 16*b*. In FIG. 1, the open interior region 3 is partitioned by several walls 5 and the loudspeaker diaphragm 16 into an acoustic chamber 18 adjacent the first major surface 16*a* and an acoustically-sealed acoustic chamber 19 adjacent the second major surface 16*b*. In FIG. 1, the acoustic chamber 18 and the acoustically-sealed acoustic chamber 19 are at least partially bounded by the first major surface 16*a* and the second major surface 16*b*, respectively.

The housing 2 also defines an acoustic port 6 from the acoustic chamber 18 to a surrounding environment 7. The port 6 and diaphragm 16 can be arranged in a so-called "side firing" arrangement, as in FIG. 1. That is to say, a cross-section (or mouth) of the port 6 can be oriented transversely relative to a major surface 16*a*, 16*b* of the diaphragm 16. For example, in FIG. 1, the port 6 is oriented such that a vector normal to the mouth of the port extends orthogonally relative to a vector normal to the loudspeaker diaphragm 16.

Although the illustrated acoustic port 6 has a cover 8 or other protective barrier to inhibit intrusion of dirt, water, or other debris into the acoustic chamber 18, some acoustic ports have no distinct cover. For example, rather than defining a single aperture as in FIG. 1, the housing 2 can define a perforated wall (not shown) extending across the mouth of the port 6.

Although the acoustic port 6 is illustrated in FIG. 1 generally as being an aperture defined by the housing wall, in some instances, the acoustic port 6 includes an acoustic duct or channel extending from the acoustic chamber 18 to an outer surface 2*a* of the housing 2 or other encasement. For example, aesthetic or other design constraints for an electronic device may cause the acoustic chamber 18 to be spaced apart from the outer surface 2*a* of the housing or other encasement. Consequently, a duct or other acoustic channel (not shown) can extend from the acoustic chamber 18 to the outer surface to acoustically connect the acoustic chamber 18 to the surrounding environment 7. Although not shown, such a duct can have internal baffles to define a circuitous path from a proximal end adjacent the acoustic chamber 18 to a distal end adjacent the outer surface 2*a*.

As shown in FIG. 1, the acoustic chamber 18 has a characteristic length, L, extending between an interior housing wall 5 and the mouth of the port 6. In general, a fundamental (or QWR) frequency of an acoustic chamber 18 with a characteristic length, L, is a frequency, f, having a wavelength, λ, equal to 4*L. Stated differently, a resonant frequency, $f_{res}$, for a typical ported acoustic chamber 18 can be estimated according the following:

$$f_{res} = c/4L$$

where c is about 343 m/s, the approximate speed of sound in air at a temperature of 20° C. FIG. 2 shows a representative frequency response 22 for such a ported acoustic chamber 18. Note the rapid loss of sound pressure level (SPL) at frequencies above $f_{res}$, where SPL reaches a local maximum.

However, the enclosure 1 shown in FIG. 1 also includes an acoustic resonator 11 acoustically coupled with the acoustic chamber 18. The resonator can be configured to resonate at a frequency substantially identical to $f_{res}$ for the acoustic chamber 18. Alternatively, the resonator 11 can be configured to resonate a frequency different from $f_{res}$ for the acoustic chamber 18.

An acoustic resonator 11 coupled with the acoustic chamber 18 tends to damp resonance at a frequency, $f_{res}$. Stated differently, the presence and configuration of the acoustic resonator 11 can spread the energy that otherwise would be concentrated at the frequency, $f_{res}$, over a wider range of frequencies. Consequently, the sound loudness, or level, radiated by the diaphragm 16 and emitted by the acoustic enclosure 1 does not increase at or near the QWR frequency, $f_{res}$, as dramatically as would otherwise be radiated and emitted at or near that frequency absent the acoustic resonator. Moreover, the damped enclosure 1 can maintain a loudness or level over a wider range of frequencies, or bandwidth, 20 compared to a bandwidth 22 attained without damping.

To further illustrate, FIG. 2 shows a representative frequency response 20 for a ported acoustic chamber damped with a resonator 11 as shown in FIG. 1 and just described. The response 20 corresponding to the damped acoustic chamber 18 has both a lower peak SPL 26, 27 and an extended bandwidth 23 compared to the representative response for an acoustic chamber without damping by an acoustic resonator.

More particularly, the peak 24 depicts the increased sound level at the QWR frequency, $f_{res}$, for the un-damped enclosure. As well, the rapid decay in level at frequencies above $f_{res}$, depicts fall-off in sound loudness at those higher frequencies. Referring now to the frequency response 20 for the damped acoustic chamber 18, the sound loudness 28 at $f_{res}$ is substantially lower than at the peak 24, yet is similar in magnitude to sound loudness at lower frequencies. Nonetheless, the sound loudness modestly increases over narrow frequency bands above and below $f_{res}$ (depicted by peaks 26, 27) for the acoustic chamber 18 damped with the acoustic resonator 11.

IV. Acoustic Resonators

In general, the acoustic resonator 11 can be any form of acoustic resonator having one or more chambers or cavities configured to resonate at a respective one or more frequencies (resonant frequencies) with greater amplitude than at other frequencies. In some enclosures, a geometry of the resonator is so tuned as to cause the resonator to resonate at one or more frequencies corresponding to a QWR frequency of the acoustic chamber 18.

Figure 3:
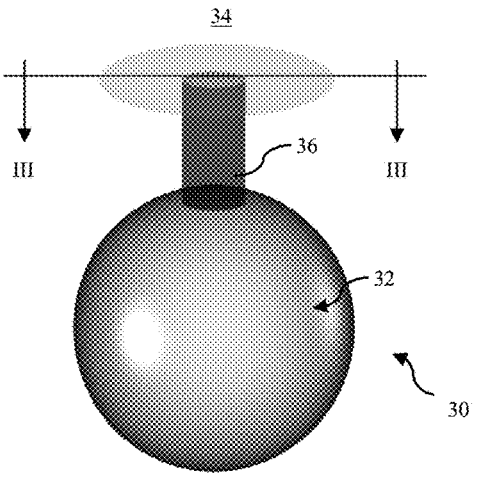
FIG. 3 schematically illustrates perspective view of a Helmholtz resonator.
Figure 3A:
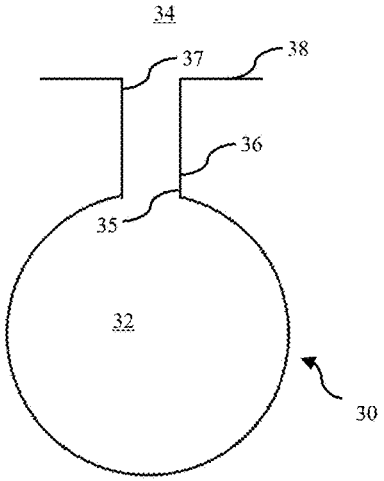
FIG. 3A schematically illustrates a cross-sectional view of the Helmholtz resonator shown in FIG. 3 along section III-III.

An example of an acoustic resonator is a so-called Helmholtz resonator, though other forms of acoustic resonator exist. As described more fully below, a plurality of individual resonators can be combined to form the resonator 11. The combined resonators may be of a same type or a different type, as compared to each other. As shown in FIG. 3, a Helmholtz resonator 30 can have a closed resonant chamber 32 (or cavity) coupled to a surrounding environment 34 by way of an acoustic channel (or duct) 36. The acoustic channel 36 can extend from a proximal end 35 open to the resonant chamber 32 to a distal end 37 open to the surrounding environment 34. As well, the acoustic channel 36 can define a contraction (e.g., a smaller cross-sectional area) relative to the resonant chamber 32 and the surrounding environment 34.

A given Helmholtz resonator's resonant frequency (i.e., the frequency at which the given Helmholtz resonator resonates with a relatively larger amplitude as compared to other frequencies) corresponds the physical arrangement of the Helmholtz resonator. For example, the resonant frequency can correspond to a volume of the resonant chamber (or cavity) 32, a characteristic width (or diameter) of the acoustic channel 36 at the proximal end 35, a characteristic width (or diameter) of the acoustic channel 36 at the distal end 37, a length of the acoustic channel 36 from the proximal end 35 to the distal end 37, as well as a whether the distal end of the channel has a flange 38 or wall extending, e.g., radially outward, of the distal end 37.

V. Acoustic Enclosures Damped with Acoustic Resonators

Some acoustic resonators coupled with the acoustic chamber 18 include a plurality of acoustic resonators coupled in series and/or in parallel with each other relative to the acoustic chamber 18. An acoustic resonator 11 having a plurality of substituent acoustic resonators 13*a*, 13*b* acoustically coupled with each other and the acoustic chamber 18, as shown for example in FIG. 1, can provide more degrees-of-freedom for tuning a degree of damping provided at a selected one or more frequencies compared to a single resonator (e.g., as shown in FIG. 3). In general, acoustic resonators described herein can include any number and type of substituent acoustic resonators acoustically coupled with the acoustic chamber 18 and coupled with each other in series and/or in parallel relative to the acoustic chamber 18.

Figure 4:
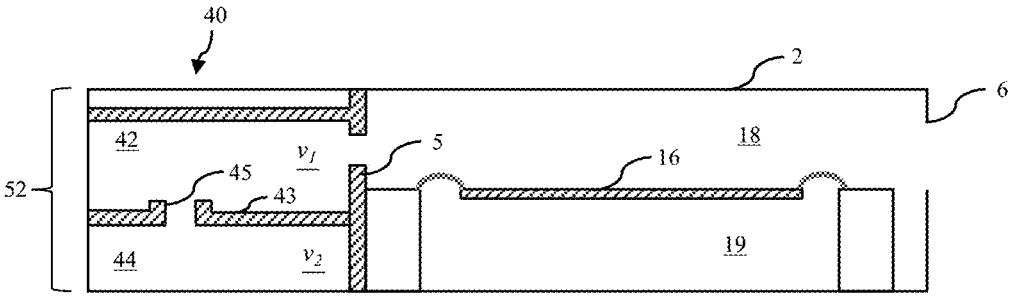
FIG. 4 illustrates a cross-sectional view of an assembly including an acoustic enclosure and a loudspeaker transducer.

As shown in FIGS. 1 and 4, an acoustic resonator 11, 40 can include two constituent, e.g., Helmholtz, resonators acoustically coupled with the acoustic chamber 18. For example, FIG. 1 shows a first resonator 13*a* and a second acoustic resonator 13*b* acoustically coupled with each other in series relative to the acoustic chamber 18. For example, the first resonator 13*a* is coupled directly with the acoustic chamber 18 and with the second resonator 13*b*. However, the illustrated second acoustic resonator 13*b* is not acoustically coupled directly with the acoustic chamber 18. Rather, the first acoustic resonator 13*a* is positioned between the second acoustic resonator 13*b* and the acoustic chamber 18. Further, in the example shown in FIG. 1, the second acoustic resonator 13*b* is positioned within a housing defining the first resonator 13*a*, and the respective resonant chambers 9*a*, 9*b* are separated from each other by a vertical wall. FIG. 4 shows a similar nested arrangement of Helmholtz resonators, albeit with the wall separating the resonant chambers rotated by about 90 degrees.

Although nested resonators 13*a*, 13*b* and 42, 44 are shown in FIGS. 1 and 4, some acoustic resonators coupled with each other in series relative to the acoustic chamber can be positioned adjacent to each other. For example, a first acoustic resonator (an intermediate resonator) can be positioned between a second acoustic resonator (a terminal acoustic resonator) and an acoustic chamber, though the first acoustic resonator need not subsume the volume of the second acoustic radiator, as in FIGS. 1 and 4. In some instances, the terminal acoustic resonator can have a larger volume than the intermediate resonator, or vice-versa.

In FIG. 1, the first Helmholtz resonator 13*a* includes a first resonant chamber 9*a* having a volume, $v_1$, and a first duct extending over a length, $l_1$, from a proximal end adjacent the chamber 9*a* to a distal end adjacent and opening to the acoustic chamber 18. The first acoustic channel (or duct) defines a contraction region $t_1$ positioned between the acoustic chamber 18 and the first resonant chamber 9*a*.

The second Helmholtz resonator 13*b* includes a second resonant chamber 9*b* having a volume, $v_2$, and a second duct extending over a length, $l_2$, from a proximal end adjacent the chamber 9*b* to a distal end adjacent and opening to the first resonant chamber 9*a*. In FIG. 1, the volume, $v_1$, is larger than the volume, $v_2$.

Each of the resonant chambers 9*a*, 9*b* in FIG. 1 is acoustically coupled with the acoustic chamber 18 adjacent the first major surface 16*a* of the diaphragm 16 and acoustically isolated from the sealed acoustic chamber 19 adjacent the opposed second major surface 16*b* of the diaphragm 16. The second acoustic channel defines a contraction region $t_2$ positioned between the first resonant chamber 9*a* and the second resonant chamber 9*b*.

Referring still to FIG. 1, the wall 9 separating the resonant chamber 9*a* from the resonant chamber 9*b* defines the second duct. In other instances, the second duct can be formed separately (e.g., as opposed to integrally) from the wall 9. As well, the wall 9 in FIG. 1, is shown as being oriented substantially parallel to, for example, the port 6 and generally transverse to the diaphragm 16. By contrast, the wall 43 shown in FIG. 4 is oriented generally orthogonal to the port 6 and generally parallel to the diaphragm 16.

Figure 5:
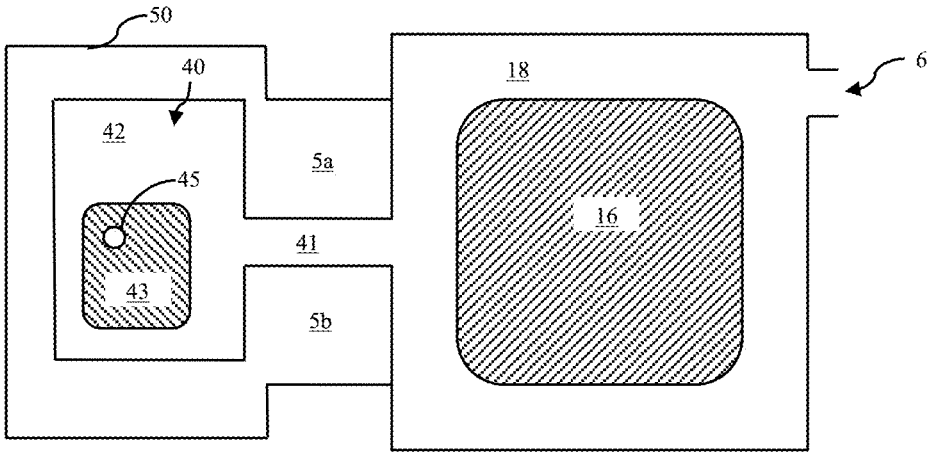
FIG. 5 illustrates a plan view, from above, of an assembly including an acoustic enclosure and a loudspeaker transducer.

In each of FIGS. 1, 4, and 5 the housing 2 includes an acoustic chassis 50 defining a recessed region 52 corresponding to the acoustic resonator 11. In FIGS. 4 and 5, the second resonant chamber 44 occupies a lower portion of the recessed region 52. In FIG. 1, the lower portion of the first and the second resonant chambers 9*a*, 9*b* occupy the recessed region 52.

Referring still to FIG. 4, either or both acoustic ducts 41, 45 can have a length generally corresponding to thickness of a wall 5 separating the respective resonant chamber 42, 44 from an adjacent acoustic chamber 18 or resonant chamber 42. For example, in FIG. 5, the acoustic chassis 50 defines a pair of longitudinally spaced-apart wall segments 5*a*, 5*b* defining a gap 41 therebetween. The wall segments 5*a*, 5*b* and the gap 41 are positioned between the recessed region 52 and the acoustic chamber 18 and are arranged to define a contraction region between the acoustic chamber 18 and the first resonant chamber 42 of the resonator 40. Although the wall segments can be longitudinally spaced apart from each other as in FIG. 5, some acoustic chassis define a wall having an aperture bounded on its perimeter by the wall 5, generally as depicted in FIG. 4.

The wall 43 separating the resonant chambers 42, 44 in FIGS. 4 and 5 can be integrally formed with the acoustic chassis 50 in some instances. In other instances, a separate, contoured insert defines the wall 43. Such an insert can be separable from and matingly engageable with the acoustic chassis 50. In either instance, the wall 43 can segregate the recessed region 52 to define the second resonant chamber 44 as a distinct chamber from the first resonant chamber 42. As well, the insert can define the acoustic channel 45 or the channel can be formed as a separate member engaged with the wall 43, e.g., of the insert.

Figure 6:
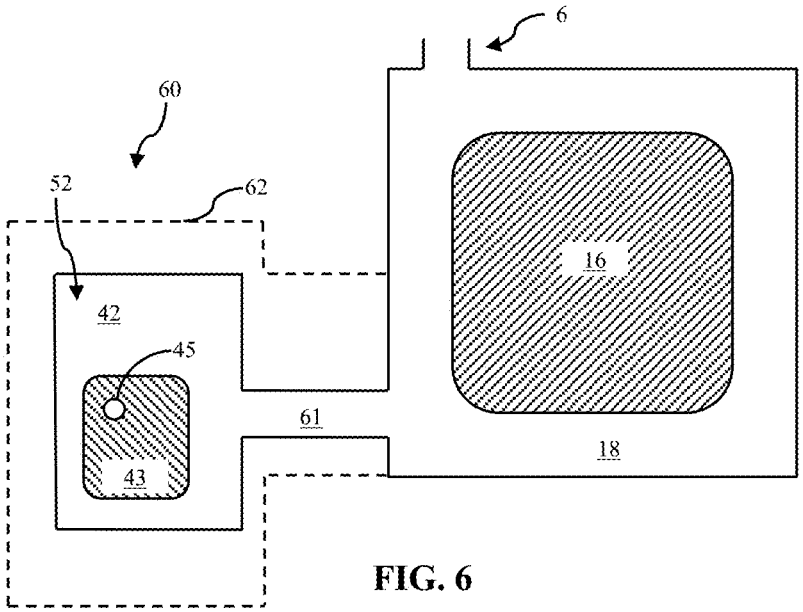
FIG. 6 illustrates a plan view, from above, of an assembly including an acoustic enclosure and a loudspeaker transducer.
Figure 7:
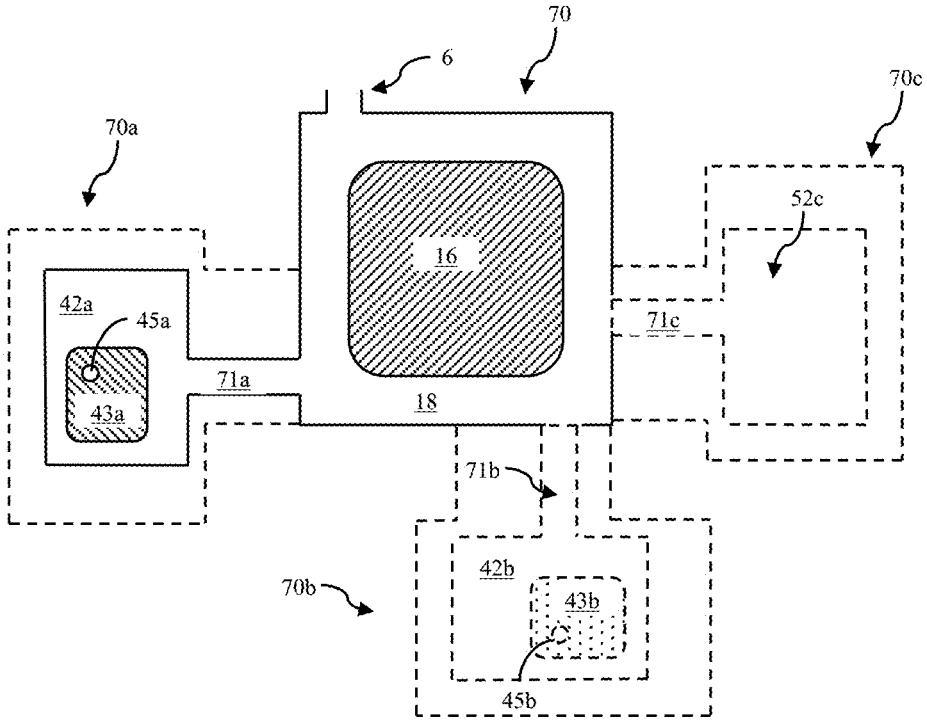
FIG. 7 illustrates a plan view, from above, of an assembly including an acoustic enclosure and a loudspeaker transducer.

FIGS. 5, 6, and 7 show respective plan views from above acoustic enclosures damped with one or more acoustically coupled acoustic resonators. In FIG. 5, the acoustic resonator 40, acoustic chamber 18 and acoustic diaphragm 16 shown in FIG. 4 are shown in a plan view from above. The acoustic resonator 40 is positioned opposite the acoustic port 6 relative to the diaphragm 16, and the acoustic duct coupling the resonator 40 with the acoustic chamber 18 opens from a wall opposite the wall from which the port 6 opens.

In FIG. 6, the acoustic resonator 60 is coupled to the acoustic chamber 18 with an acoustic duct 61 extending from a wall 62 orthogonal with the wall from which the acoustic port 6 opens. In both FIGS. 5 and 6, the resonator 40, 60 includes first and second resonant chambers acoustically coupled with each other in series relative to the acoustic chamber 18. The dashed line 62 indicates that the resonator 60 can fit with an acoustic chassis or be formed separately from such a chassis.

FIG. 7 shows alternative arrangements 70*a*, 70*b*, 70*c* of an acoustic resonator. For example, like the resonator 60 in FIG. 6, the resonator 70*a* in FIG. 7 includes nested and stacked first and second resonant chambers arranged similarly as in FIG. 4, with chamber 42*a* shown in FIG. 7 and the chamber corresponding to chamber 44 (FIG. 4) hidden below the wall 43*a*. In FIG. 7, the first and second resonant chambers are acoustically coupled with each other in series relative to the acoustic chamber 18, and separated from each other by a wall 43*a*. As well, FIG. 7 shows that one or more other acoustic resonators 70*b*, 70*c* can be acoustically coupled with the resonator 70*a* in parallel relative to the acoustic chamber 18. For example, the resonators 70*a*, 70*b*, 70*c* are acoustically coupled with the acoustic chamber 18 by way of a respective acoustic duct 71*a*, 71*b*, 71*c*.

And, one or more of the parallel resonators 70*b*, 70*c* can have a first resonant chamber 42*b* and a second resonant chamber (similar to chamber 44 in FIG. 4) acoustically coupled with each other in series relative to the acoustic chamber 18. For example, the first resonant chamber 42*b* and the second resonant chamber can be separated from each other by a wall 43*b* and acoustically coupled with each other in series relative to the acoustic chamber 18 by way of the duct 45*b*. And, for illustrative purposes, the resonator 70*c* is shown has having a single resonant chamber 52*c* corresponding to a recessed region in an acoustic chassis. Such alternative arrangements can provide further degrees-of-freedom for tuning the enclosure 2 compared to the enclosure arrangement depicted, for example, in FIGS. 1, 4, 5, and 6.

VI. Electronic Devices with Damped Acoustic Chambers

Figure 8:
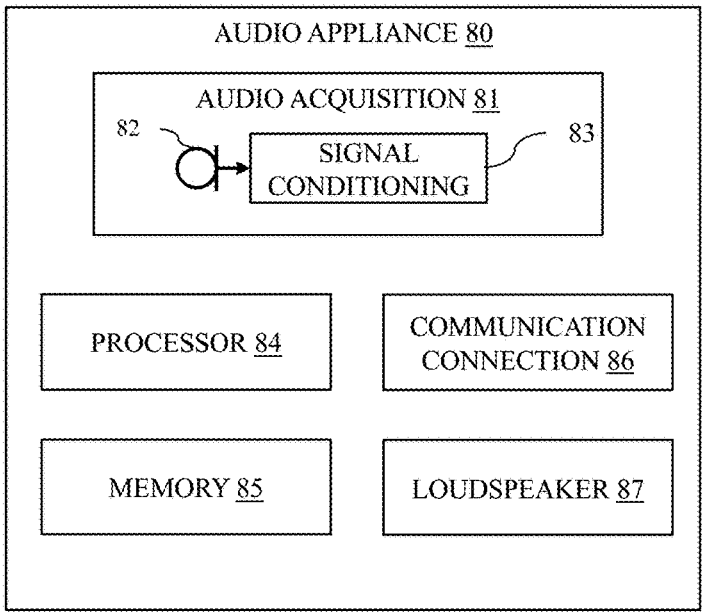
FIG. 8 illustrates a block diagram showing aspects of an audio appliance.

Referring now to FIG. 8, electronic devices having damped acoustic chambers are described by way of reference to a specific example of an audio appliance. Electronic devices represent but one possible class of computing environments which can incorporate an acoustic enclosure, and more particularly, a damped acoustic chamber, as described herein. Nonetheless, electronic devices are succinctly described in relation to a particular audio appliance 80 to illustrate an example of a system incorporating and benefitting from a damped acoustic chamber.

As shown in FIG. 8, an audio appliance 80 or other electronic device can include, in its most basic form, a processor 84, a memory 85, and a loudspeaker or other electro-acoustic transducer 87, and associated circuitry (e.g., a signal bus, which is omitted from FIG. 8 for clarity). The memory 85 can store instructions that, when executed by the processor 84, cause the circuitry in the audio appliance 80 to drive the electro-acoustic transducer 87 to emit sound over a selected frequency bandwidth.

In addition, the audio appliance 80 can have a ported acoustic chamber positioned adjacent the electro-acoustic transducer, together with an acoustic resonator acoustically coupled with the acoustic chamber. As described above, the acoustic resonator can include a first resonant chamber and a second resonant chamber acoustically coupled with each other and the acoustic chamber. The acoustic resonator can be arranged to resonate at a frequency corresponding to a quarter-wavelength resonance of the ported acoustic chamber to extend a frequency bandwidth of sound emitted by the electronic device compared to the selected frequency bandwidth emitted by the electro-acoustic transducer.

The audio appliance 80 schematically illustrated in FIG. 8 also includes a communication connection 86, as to establish communication with another computing environment. As well, the audio appliance 80 includes an audio acquisition module 81 having a microphone transducer 82 to convert incident sound to an electrical signal, together with a signal conditioning module 83 to condition (e.g., sample, filter, and/or otherwise condition) the electrical signal emitted by the microphone. In addition, the memory 85 can store other instructions that, when executed by the processor, cause the audio appliance 80 to perform any of a variety of tasks akin to a general computing environment as described more fully below in connection with FIG. 9.

VII. Acoustic Signal Conditioning

A damped acoustic chamber 18 as described herein can radiate sound over a broader bandwidth and can also require less conditioning of an acoustic signal as compared to a degree of signal conditioning applied to the acoustic signal when played through un-damped acoustic chambers. For example, an amplitude of a signal used to drive a loudspeaker transducer can be diminished at and near the resonant frequency of an un-damped acoustic chamber to de-emphasize that frequency during audio playback. However, such signal conditioning can be computationally intensive. An acoustically damped acoustic chamber described herein can acoustically damp selected frequencies and allow for less signal conditioning and reduce computational overhead during audio playback. Such signal conditioning can be performed in software, firmware, or hardware (e.g., using an ASIC).

VIII. Computing Environments

Figure 9:
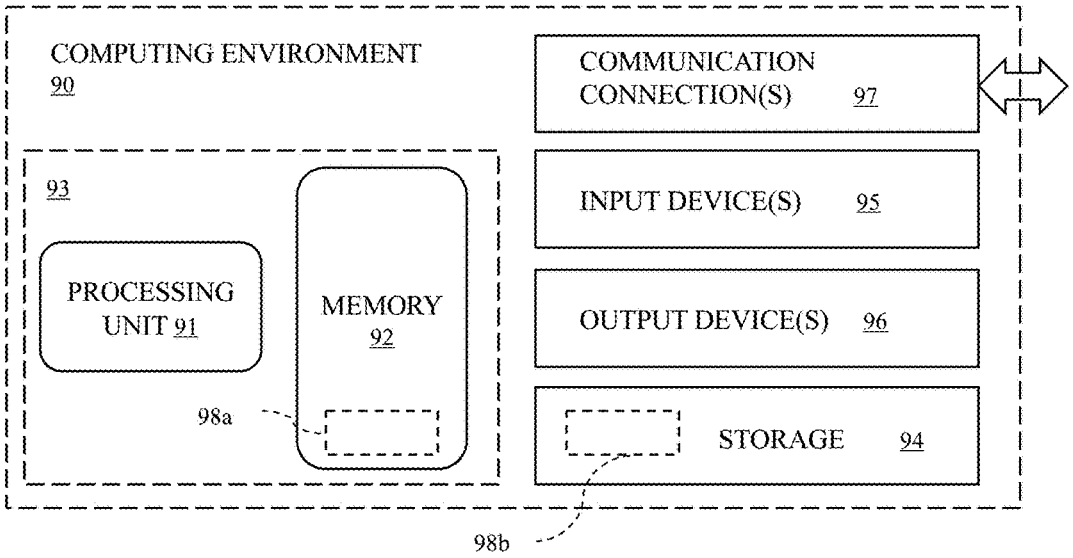
FIG. 9 illustrates a block diagram showing aspects of a computing environment.

FIG. 9 illustrates a generalized example of a suitable computing environment 90 in which described methods, embodiments, techniques, and technologies relating, for example, to acoustic control for an appliance, e.g., an audio appliance can be implemented. The computing environment 90 is not intended to suggest any limitation as to scope of use or functionality of the technologies disclosed herein, as each technology may be implemented in diverse general-purpose or special-purpose computing environments, including within an audio appliance. For example, each disclosed technology may be implemented with other computer system configurations, including wearable and/or handheld appliances (e.g., a mobile-communications device, such as, for example, IPHONE®/IPAD®/AIRPODS®/HOMEPOD™ devices, available from Apple Inc. of Cupertino, Calif.), multiprocessor systems, microprocessor-based or programmable consumer electronics, embedded platforms, network computers, minicomputers, mainframe computers, smartphones, tablet computers, data centers, audio appliances, and the like. Each disclosed technology may also be practiced in distributed computing environments where tasks are performed by remote processing devices that are linked through a communications connection or network. In a distributed computing environment, program modules may be located in both local and remote memory storage devices.

The computing environment 90 includes at least one central processing unit 91 and a memory 92. In FIG. 9, this most basic configuration 93 is included within a dashed line. The central processing unit 91 executes computer-executable instructions and may be a real or a virtual processor. In a multi-processing system, or in a multi-core central processing unit, multiple processing units execute computer-executable instructions (e.g., threads) to increase processing speed and as such, multiple processors can run simultaneously, despite the processing unit 91 being represented by a single functional block.

A processing unit, or processor, can include an application specific integrated circuit (ASIC), a general-purpose microprocessor, a field-programmable gate array (FPGA), a digital signal controller, or a set of hardware logic structures (e.g., filters, arithmetic logic units, and dedicated state machines) arranged to process instructions.

The memory 92 may be volatile memory (e.g., registers, cache, RAM), non-volatile memory (e.g., ROM, EEPROM, flash memory, etc.), or some combination of the two. The memory 92 stores instructions for software 98*a* that can, for example, implement one or more of the technologies described herein, when executed by a processor. Disclosed technologies can be embodied in software, firmware or hardware (e.g., an ASIC).

A computing environment may have additional features. For example, the computing environment 90 includes storage 94, one or more input devices 95, one or more output devices 96, and one or more communication connections 97. An interconnection mechanism (not shown) such as a bus, a controller, or a network, can interconnect the components of the computing environment 90. Typically, operating system software (not shown) provides an operating environment for other software executing in the computing environment 90, and coordinates activities of the components of the computing environment 90.

The store 94 may be removable or non-removable, and can include selected forms of machine-readable media. In general, machine-readable media includes magnetic disks, magnetic tapes or cassettes, non-volatile solid-state memory, CD-ROMs, CD-RWs, DVDs, magnetic tape, optical data storage devices, and carrier waves, or any other machine-readable medium which can be used to store information, and which can be accessed within the computing environment 90. The storage 94 can store instructions for the software 98*b* that can, for example, implement technologies described herein, when executed by a processor.

The store 94 can also be distributed, e.g., over a network so that software instructions are stored and executed in a distributed fashion. In other embodiments, e.g., in which the store 94, or a portion thereof, is embodied as an arrangement of hardwired logic structures, some (or all) of these operations can be performed by specific hardware components that contain the hardwired logic structures. The store 94 can further be distributed, as between or among machine-readable media and selected arrangements of hardwired logic structures. Processing operations disclosed herein can be performed by any combination of programmed data processing components and hardwired circuit, or logic, components.

The input device(s) 95 may be any one or more of the following: a touch input device, such as a keyboard, keypad, mouse, pen, touchscreen, touch pad, or trackball; a voice input device, such as one or more microphone transducers, speech-recognition technologies and processors, and combinations thereof; a scanning device; or another device, that provides input to the computing environment 90. For audio, the input device(s) 95 may include a microphone or other transducer (e.g., a sound card or similar device that accepts audio input in analog or digital form), or a computer-readable media reader that provides audio samples and/or machine-readable transcriptions thereof to the computing environment 90.

Speech-recognition technologies that serve as an input device can include any of a variety of signal conditioners and controllers, and can be implemented in software, firmware, or hardware. Further, the speech-recognition technologies can be implemented in a plurality of functional modules. The functional modules, in turn, can be implemented within a single computing environment and/or distributed between or among a plurality of networked computing environments. Each such networked computing environment can be in communication with one or more other computing environments implementing a functional module of the speech-recognition technologies by way of a communication connection.

The output device(s) 96 may be any one or more of a display, printer, loudspeaker transducer, DVD-writer, signal transmitter, or another device that provides output from the computing environment 90. An output device can include or be embodied as a communication connection 97.

The communication connection(s) 97 enable communication over or through a communication medium (e.g., a connecting network) to another computing entity. A communication connection can include a transmitter and a receiver suitable for communicating over a local area network (LAN), a wide area network (WAN) connection, or both. LAN and WAN connections can be facilitated by a wired connection or a wireless connection. If a LAN or a WAN connection is wireless, the communication connection can include one or more antennas or antenna arrays. The communication medium conveys information such as computer-executable instructions, compressed graphics information, processed signal information (including processed audio signals), or other data in a modulated data signal. Examples of communication media for so-called wired connections include fiber-optic cables and copper wires. Communication media for wireless communications can include electromagnetic radiation within one or more selected frequency bands.

Machine-readable media are any available media that can be accessed within a computing environment 90. By way of example, and not limitation, with the computing environment 90, machine-readable media include memory 92, storage 94, communication media (not shown), and combinations of any of the above. Tangible machine-readable (or computer-readable) media exclude transitory signals.

As explained above, some disclosed principles can be embodied in a store 94. Such a store can include tangible, non-transitory machine-readable medium (such as microelectronic memory) having stored thereon or therein instructions. The instructions can program one or more data processing components (generically referred to here as a "processor") to perform one or more processing operations described herein, including estimating, computing, calculating, measuring, adjusting, sensing, measuring, filtering, correlating, and decision making, as well as, by way of example, addition, subtraction, inversion, and comparison. In some embodiments, some or all of these operations (of a machine process) can be performed by specific electronic hardware components that contain hardwired logic (e.g., dedicated digital filter blocks). Those operations can alternatively be performed by any combination of programmed data processing components and fixed, or hardwired, circuit components.

IX. Other Embodiments

The examples described above generally concern acoustic chambers damped with plural resonant chambers, and related systems and methods. The previous description is provided to enable a person skilled in the art to make or use the disclosed principles. Embodiments other than those described above in detail are contemplated based on the principles disclosed herein, together with any attendant changes in configurations of the respective apparatus described herein, without departing from the spirit or scope of this disclosure. Various modifications to the examples described herein will be readily apparent to those skilled in the art.

Directions and other relative references (e.g., up, down, top, bottom, left, right, rearward, forward, etc.) may be used to facilitate discussion of the drawings and principles herein, but are not intended to be limiting. For example, certain terms may be used such as "up," "down,", "upper," "lower," "horizontal," "vertical," "left," "right," and the like. Such terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" surface can become a "lower" surface simply by turning the object over. Nevertheless, it is still the same surface and the object remains the same. As used herein, "and/or" means "and" or "or", as well as "and" and "or." Moreover, all patent and non-patent literature cited herein is hereby incorporated by reference in its entirety for all purposes.

And, those of ordinary skill in the art will appreciate that the exemplary embodiments disclosed herein can be adapted to various configurations and/or uses without departing from the disclosed principles. Applying the principles disclosed herein, it is possible to provide a wide variety of damped acoustic enclosures, and related methods and systems. For example, the principles described above in connection with any particular example can be combined with the principles described in connection with another example described herein. Thus, all structural and functional equivalents to the features and method acts of the various embodiments described throughout the disclosure that are known or later come to be known to those of ordinary skill in the art are intended to be encompassed by the principles described and the features claimed herein. Accordingly, neither the claims nor this detailed description shall be construed in a limiting sense, and following a review of this disclosure, those of ordinary skill in the art will appreciate the wide variety of audio appliances, and related methods and systems that can be devised under disclosed and claimed concepts.

Moreover, nothing disclosed herein is intended to be dedicated to the public regardless of whether such disclosure is explicitly recited in the claims. No claim feature is to be construed under the provisions of 35 USC 112(f), unless the feature is expressly recited using the phrase "means for" or "step for".

The appended claims are not intended to be limited to the embodiments shown herein, but are to be accorded the full scope consistent with the language of the claims, wherein reference to a feature in the singular, such as by use of the article "a" or "an" is not intended to mean "one and only one" unless specifically so stated, but rather "one or more". Further, in view of the many possible embodiments to which the disclosed principles can be applied, I reserve to the right to claim any and all combinations of features and technologies described herein as understood by a person of ordinary skill in the art, including, for example, all that comes within the scope and spirit of the following claims.

We currently claim:

1. An acoustic enclosure comprising:

a housing at least partially defining an acoustic chamber for an acoustic radiator, wherein the housing further defines an acoustic port from the acoustic chamber to a surrounding environment;

an acoustic resonator having a first resonant chamber and a second resonant chamber, wherein the acoustic resonator comprises a first duct to acoustically couple the first resonant chamber with the acoustic chamber and a second duct to acoustically couple the second resonant chamber with the first resonant chamber.

2. An acoustic enclosure according to claim 1, wherein the acoustic resonator is arranged to resonate at a frequency corresponding to a quarter-wavelength resonance of the acoustic chamber to extend a frequency bandwidth of sound emitted within the acoustic chamber.

3. An acoustic enclosure according to claim 1, wherein the first acoustic duct defines a contraction region positioned between the acoustic chamber and the first resonant chamber.

4. An acoustic enclosure according to claim 3, wherein the second acoustic duct defines a contraction region positioned between the first resonant chamber and the second resonant chamber.

5. An acoustic enclosure according to claim 1, wherein the housing comprises an acoustic chassis, wherein the acoustic chassis defines a pair of longitudinally spaced-apart wall segments defining a gap therebetween and a recessed region corresponding to the resonator, wherein the wall segments and the gap are positioned between the recessed region and the acoustic chamber and arranged to define a contraction region between the acoustic chamber and the first resonant chamber of the resonator.

6. An acoustic enclosure according to claim 5, further comprising an insert matingly engageable with the acoustic chassis to segregate the recessed region and to define the second resonant chamber between the insert and a corresponding segregated portion of the recessed region, wherein the insert defines the second duct.

7. An acoustic enclosure according to claim 1, wherein the acoustic resonator comprises a first acoustic resonator and the acoustic enclosure further comprises a second acoustic resonator acoustically coupled with the acoustic chamber.

8. A loudspeaker assembly comprising:

an acoustic radiator having a first major surface and an opposed second major surface;

a housing defining an acoustic chamber positioned adjacent, and at least partially bounded by, the first major surface of the acoustic radiator, wherein the housing further defines an acoustic port from the acoustic chamber to a surrounding environment;

an acoustic resonator having a first resonant chamber and a second resonant chamber, wherein the acoustic resonator comprises a first duct to acoustically couple the first resonant chamber with the acoustic chamber and a second duct to acoustically couple the second resonant chamber with the first resonant chamber.

9. A loudspeaker assembly according to claim 8, wherein the second major surface of the acoustic radiator defines a boundary of an adjacent region, wherein the adjacent region is acoustically decoupled from the acoustic chamber, the first resonant chamber, the second resonant chamber, or a combination thereof.

10. A loudspeaker assembly according to claim 8, wherein the first duct defines a contraction region positioned between the acoustic chamber and the first resonant chamber.

11. A loudspeaker assembly according to claim 8, wherein the second duct defines a contraction region positioned between the first resonant chamber and the second resonant chamber.

12. A loudspeaker assembly according to claim 8, further comprising an insert defining a wall separating the first resonant chamber from the second resonant chamber, wherein the second duct comprises an aperture extending through the wall from the first resonant chamber to the second resonant chamber.

13. A loudspeaker assembly according to claim 8, further comprising a wall positioned between the acoustic chamber and the first resonant chamber, wherein the wall defines an open gap, and wherein the first acoustic duct comprises the open gap.

14. A loudspeaker assembly according to claim 8, wherein the acoustic resonator comprises a first acoustic resonator, wherein the loudspeaker assembly further comprises a second acoustic resonator.

15. A loudspeaker assembly according to claim 8, wherein the acoustic resonator is arranged to resonate at a frequency corresponding to a quarter-wavelength resonance of the acoustic chamber to extend a frequency bandwidth of sound emitted by the acoustic radiator.

16. An electronic device, comprising:

an electro-acoustic transducer;

circuitry to drive the electro-acoustic transducer to emit sound over a selected frequency bandwidth;

a ported acoustic chamber positioned adjacent the electro-acoustic transducer; and an acoustic resonator having a first resonant chamber and a second resonant chamber, wherein the first resonant chamber is acoustically coupled with and positioned between the acoustic chamber and the second resonant chamber.

17. An electronic device according to claim 16, wherein the acoustic resonator is arranged to resonate at a frequency corresponding to a quarter-wavelength resonance of the ported acoustic chamber to extend a frequency bandwidth of sound emitted by the electronic device compared to the selected frequency bandwidth emitted by the electro-acoustic transducer.

18. An electronic device according to claim 16, wherein the acoustic resonator comprises a first acoustic resonator, the electronic device comprising a second acoustic resonator.

19. An electronic device according to claim 18, wherein the second acoustic resonator comprises a corresponding first resonant chamber and a corresponding second resonant chamber, wherein the first resonant chamber corresponding to the second acoustic radiator acoustically couples with and is positioned between the acoustic chamber and the second resonant chamber corresponding to the second acoustic resonator.

20. An electronic device according to claim 16, further comprising a wall positioned between the acoustic chamber and the first resonant chamber, wherein an opening extends through the wall to acoustically couple the acoustic chamber with the first resonant chamber, wherein the electronic device further comprises another wall positioned between the first resonant chamber and the second resonant chamber, wherein an opening extends through the other wall to acoustically couple the first resonant chamber with the second resonant chamber.

* * * * *